US007490534B2

(12) United States Patent
Hine et al.

(10) Patent No.: US 7,490,534 B2
(45) Date of Patent: Feb. 17, 2009

(54) CORK EXTRACTOR APPARATUS AND METHOD

(76) Inventors: Jorge Hine, 100 al Sur de la Ferreteria del Mar, Casa Esquinera Mano Derecha, San Pedro de Montes Oca (CR); Claudio Alvarez, 452 Harbor Dr., Key Biscayne, FL (US) 33149

( * ) Notice: Subject to any disclaimer, the term of this patent is extended or adjusted under 35 U.S.C. 154(b) by 137 days.

(21) Appl. No.: 11/547,859

(22) PCT Filed: Dec. 3, 2004

(86) PCT No.: PCT/US2004/040520

§ 371 (c)(1),
(2), (4) Date: Jan. 25, 2007

(87) PCT Pub. No.: WO2005/056463

PCT Pub. Date: Jun. 23, 2005

(65) Prior Publication Data

US 2007/0151420 A1 Jul. 5, 2007

(51) Int. Cl.
*B67B 7/06* (2006.01)

(52) U.S. Cl. ..... 81/3.36; 81/3.44; 81/3.56

(58) Field of Classification Search ..... 81/3.36, 81/3.08, 3.37, 3.29, 3.55, 3.56, 3.44, 303, 81/308

See application file for complete search history.

(56) References Cited

U.S. PATENT DOCUMENTS

| | | | | | |
|---|---|---|---|---|---|
| 492,570 | A * | 2/1893 | Casey | ..... | 81/3.36 |
| 4,018,110 | A * | 4/1977 | Spriggs | ..... | 81/3.08 |
| 4,680,993 | A * | 7/1987 | Feliz | ..... | 81/3.37 |
| 4,708,033 | A * | 11/1987 | Eash | ..... | 81/3.37 |
| 4,729,267 | A * | 3/1988 | Giebeler | ..... | 81/3.37 |
| 5,000,063 | A * | 3/1991 | Federighi, Sr. | ..... | 81/3.37 |
| 5,016,499 | A * | 5/1991 | Saveland | ..... | 81/3.37 |
| 6,637,295 | B2 * | 10/2003 | Weaver | ..... | 81/3.37 |
| 7,146,879 | B2 * | 12/2006 | Crudgington, Jr. | ..... | 81/3.36 |

* cited by examiner

*Primary Examiner*—Hadi Shakeri
(74) *Attorney, Agent, or Firm*—Abelman, Frayne & Schwab

(57) ABSTRACT

A cork extractor for removing a cork from a bottle includes a first gripping member and a second gripping member having flanges that engage the bottle and sliding jaw members that grip a portion of the cork extending out from the neck of the bottle. The jaws slide in a channel defined in the head portions of each of the opposing gripping members. An extractor lever is connected to the sliding jaws and includes a contact plate that is positioned over the cork to prevent the cork from ejecting from the bottle in an uncontrolled manner. The extractor lever is pivotally connected to one of the gripping members for moving the jaws. A locking mechanism fixes the position of the first and second gripping members when the handles are closed to engage the cork and bottle. A method for removing a cork from a bottle using the cork extractor is also provided.

20 Claims, 4 Drawing Sheets

CORK EXTRACTOR APPARATUS AND METHOD

FIELD OF THE INVENTION

The present invention relates to an apparatus and method for extracting a cork from a bottle and specifically for extracting a cork that extends at least partially from the neck of the bottle.

BACKGROUND OF THE INVENTION

Bottles of champagne and sparkling wine are opened with a concern for safety that can be created by the unintended projection of the cork from the neck of the bottle at a velocity that can cause personal injury or property damage. The process for manually opening champagne bottles having at least partially external corks includes removing any outer foil wrapper and the wire basket and then cautiously removing the cork. Corks are manually removed by rotating and/or, directing pressure on the cork relative to the bottle. As the frictional forces holding the cork are overcome, the cork is projected from the bottle.

Devices for aiding the extraction of corks from champagne bottles can provide for a controlled release of pressure, and attempt to limit the unintended popping of the cork as a projectile from the bottle. Cork removing devices vary in their structures and methods and can range from a complex assembly mounted on a table or platform to hand held devices.

These devices, however, either lack the mobility of a hand held device or fail to provide an adequate measure of safety against the unexpected projection of a cork from the bottle.

It is therefore a principal object of the invention to provide an apparatus and a method of using a hand-held cork extractor from champagne type bottles that engages the neck of the bottle, separately grips the cork and permits a controlled extraction of the cork from the bottle.

It is another object of the invention to provide an apparatus and a method of using a hand held champagne cork extractor that includes a safety cover that is positionable over the cork during the controlled extraction process.

SUMMARY OF THE INVENTION

The above objects and other advantages are provided by the cork extractor apparatus and method of the present invention, an apparatus is provided which functions as a cork extractor for champagne type bottles. According to the present invention, the hand held cork extractor engages the bottle and separately grips the bottle's cork in movable jaws. The cork extractor extends over the top of the cork and prevents its outward projection as it is extracted from the neck or neck opening of the bottle by the moving of the jaws. The present invention thus permits a degree of safety for the removal of a cork using a hand held device that heretofore has been unachievable without the use of a more complex assembly.

The cork extractor is a pliers type device further including an extractor lever. The pliers include a first gripping member and a second gripping member pivotally engaged. Each gripping member has a head and an opposing handle. The heads include a fixed flange and a sliding jaw. The cork extractor engages the bottle and grips the cork in the sliding jaws. The extractor lever has a plate for positioning over the cork that is also connected with the sliding jaws within the heads of the gripping members. Pivoting the extractor lever slides the jaws within their respective heads and away from the fixed flanges.

A method of extracting a cork from a champagne or sparkling wine bottle provides for the safe and rapid manual extraction of the cork. The method includes positioning the plate of the extractor lever over the cork automatically aligning the flanges and the jaws for engaging the bottle and gripping the cork upon closing of the heads of the gripping members. Closing the jaws to engage a locking mechanism and retains the gripping members in the closed position with the bottle and cork. The basket over the cork is loosened and the extractor lever is pivotally rotated to move the jaws gripping the cork relative to the bottle retained by the flanges. The pivoting of the extractor lever to extract the cork and the holding of the gripping members can be performed using a single hand. With the cork removed, the locking mechanism is released, the cork discarded and the cork extractor automatically returns to the initial position for use.

BRIEF DESCRIPTION OF THE DRAWINGS

Preferred embodiments of the invention are described below with reference to the drawings, wherein like numerals are used to refer to the same or similar elements.

DETAILED DESCRIPTION OF PREFERRED EMBODIMENT

Figure 1:
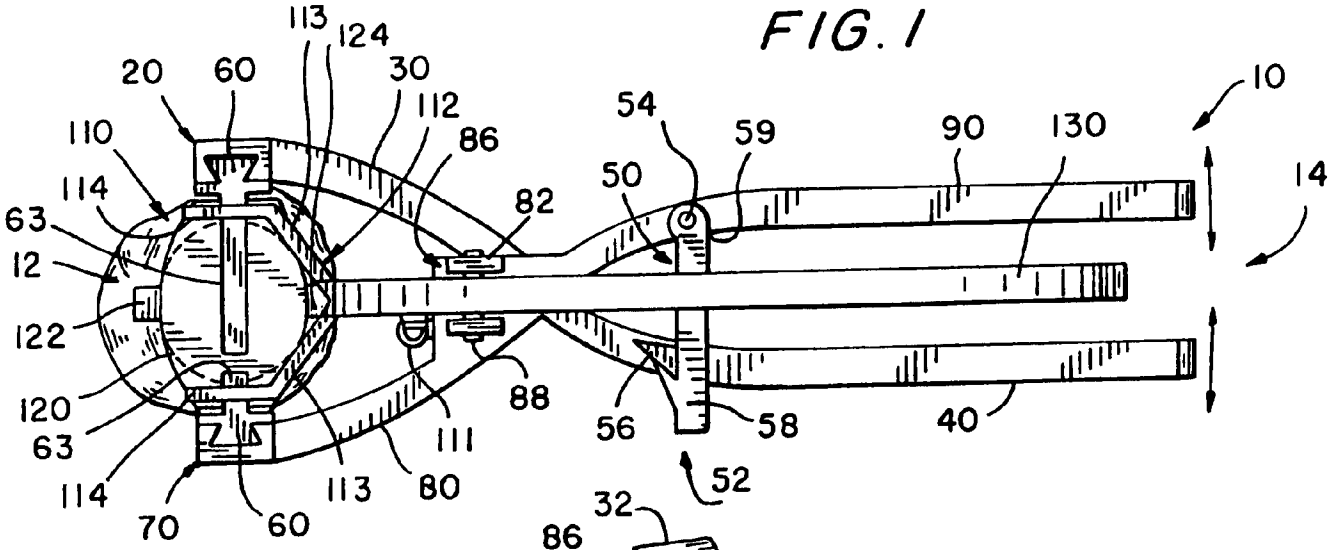
FIG. 1 is a top plan view of one embodiment of a cork extractor of the present invention.
Figures 2, 5:
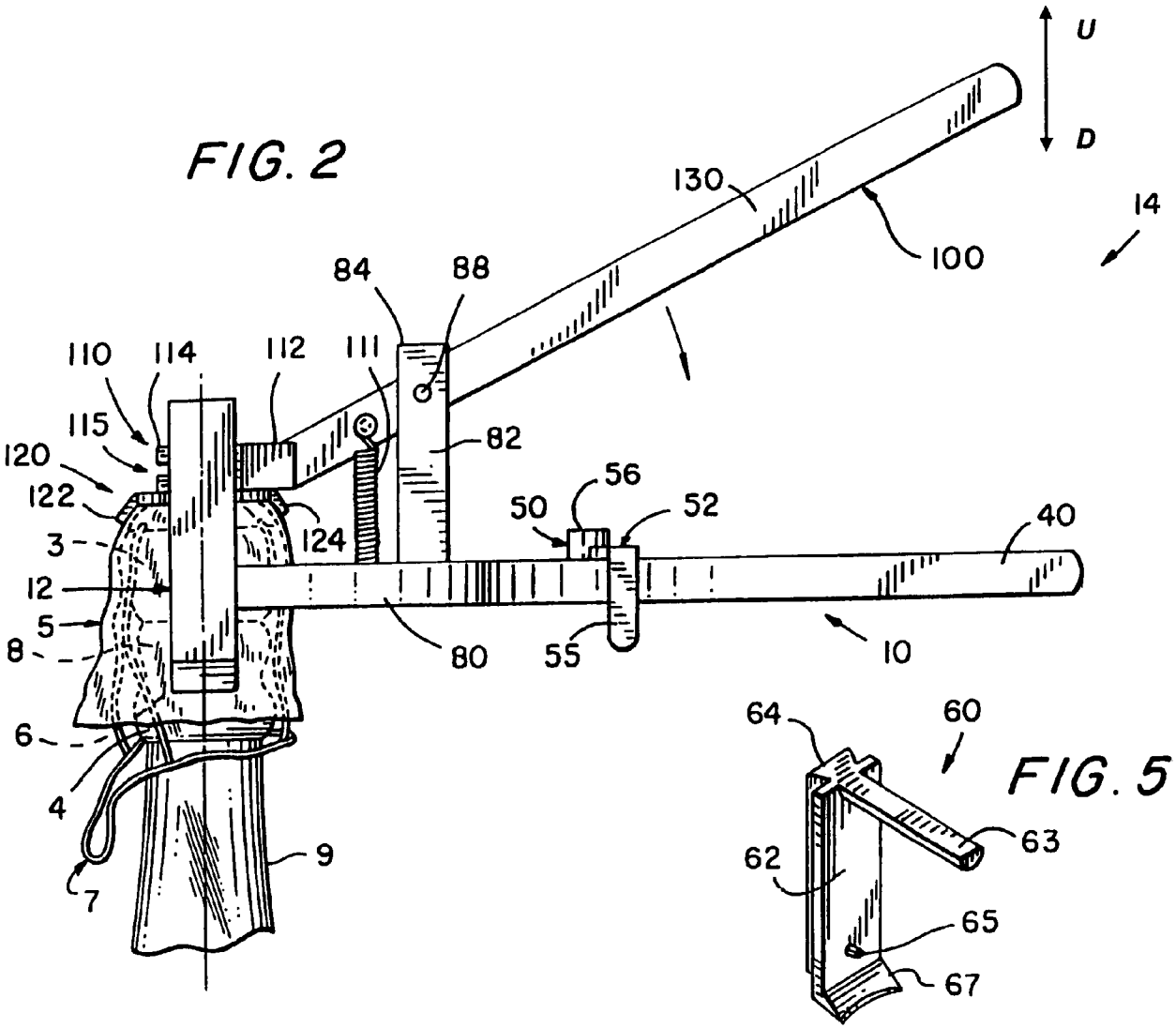
FIG. 2 is a side elevational view of the cork extractor of FIG. 1.
FIG. 5 is a side perspective view of one of the opposing sliding jaw members of the cork extractor of FIG. 1.

Referring to FIGS. 1 and 2, cork extractor 10 having a distal end 12 and a proximal end 14. Extractor 10 also defines an upward direction and downward direction as shown by reference arrows "U" and "D" that are aligned with a longitudinal axis of the bottle and perpendicular to the first plane. It is understood that cork extractor 10 could be used at any angle or in any direction.

Cork extractor 10 includes a first gripping member 20, a second gripping member 70 and an extractor lever 100. First gripping member 20 and second gripping member 70 are pivotally engaged in sliding relation in a first plane. Gripping member 20 has a right head portion 30 connected to a left handle 40. Gripping member 70 has a left head portion 80 that is connected to a right handle 90. Heads 30 and 70 are preferably elongate arcuate members. First gripping member 20 and second gripping member 80 include a locking mechanism 50 that can fix the relative positions of pivotally rotating members 20 and 70.

Second gripping member 70 includes an extractor support 82 that is preferably positioned on a portion of head 80. Support 82 extends upward, is transverse to the first plane and has a terminal end 84 that has a pivotal interface with extractor lever 100. In one preferred embodiment, terminal end 84 is bifurcated defining a slot 86 for receiving extractor lever 100. A pin 88 locks terminal end 84 and extractor lever 100 into pivotal rotation with support 82. Support 82 functions as a fulcrum for the pivotal rotation of extractor lever 100. It is understood that the positioning and type of pivotal interface between support 82 and extractor lever 100 can vary to include support 82 positioned on any other portion of cork extractor 10 that supports the pivotal rotation of extractor lever 100.

Figure 3:
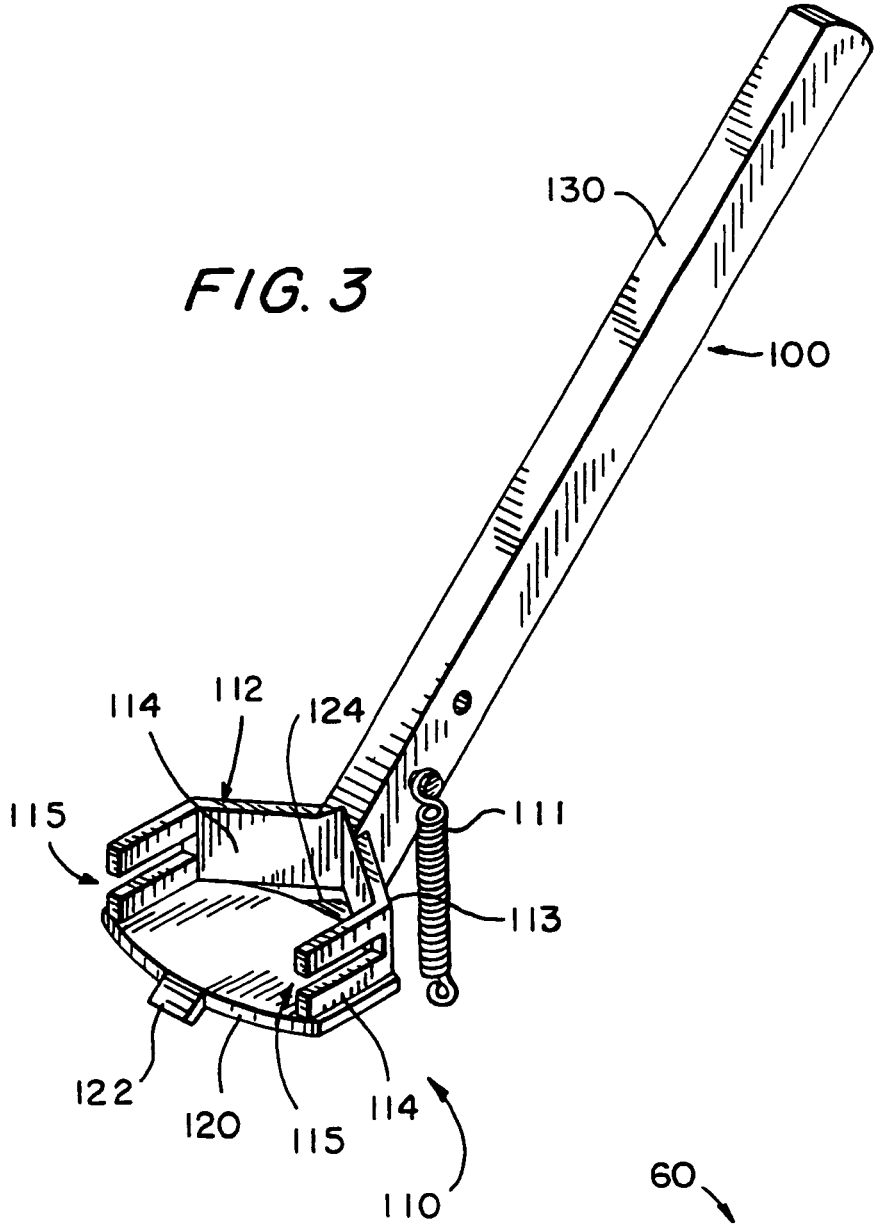
FIG. 3 is a top and side perspective view of an extractor lever of the cork extractor of FIG. 1.
Figure 6:
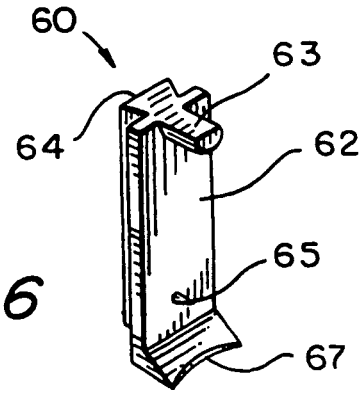
FIG. 6 is a side perspective view of the other sliding jaw member of the cork extractor of FIG. 1.
Figure 7:
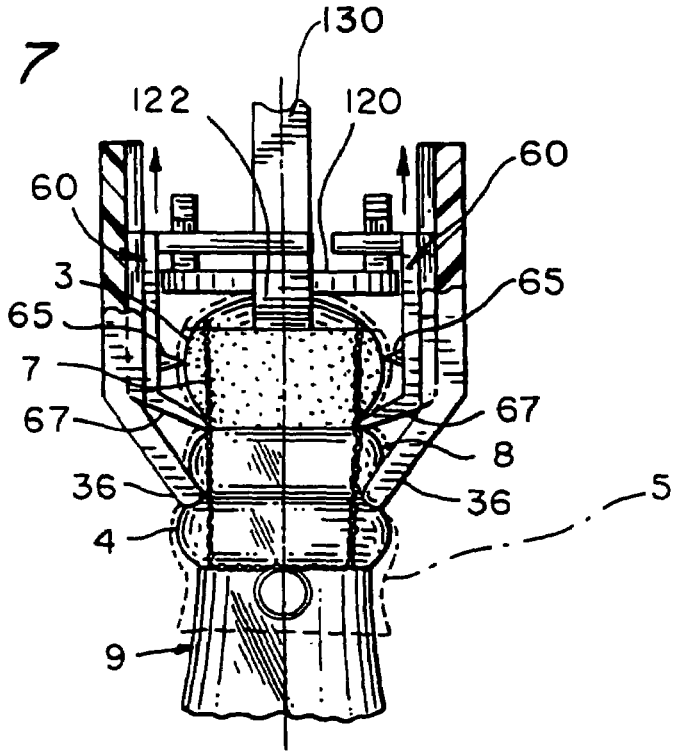
FIG. 7 is a front elevational view of the cork extractor of FIG. 1 gripping a cork extending from a bottle.
Figure 8:
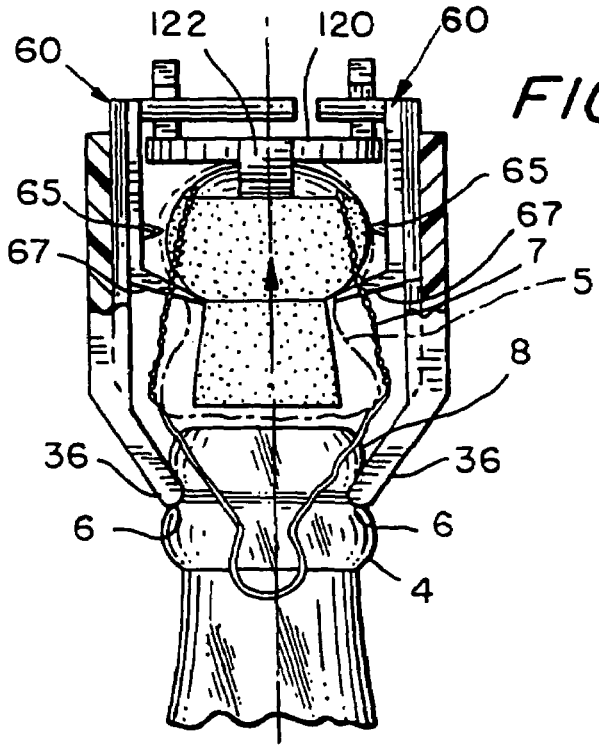
FIG. 8 is a front elevational view similar to FIG. 7 with the cork extracted from the bottle.

As shown in FIGS. 1-3, extractor lever 100 is preferably a straight elongate member having a distally positioned head portion 110 connected to a proximally positioned handle 130. A bias member 111 is connected between extractor lever 100 and second gripping member 70 and urges head 110 in a downward direction and handle 130 in the corresponding opposing generally upward direction preferably perpendicular to the first plane. Bias member 111 urges extractor lever 100 to a first position.

Head 110 includes a wall 112 and a plate 120 having an orientation transverse to the alignment of handle 130 such that when cork extractor 10 is in the first position, plate 120 is approximately parallel to the first plane. Wall 112 has a rear wall 113 connected with two sidewalls 114. Sidewalls 114 define a slot 115 generally aligned with the first plane and extending distally from wall 113.

Plate 120 is connected to wall 112 and has a generally elliptical shape that at least substantially covers over cork 3. Plate 120 includes a first tab 122 extending generally distally and downward and a second tab 124 extending generally proximally and downward. In one preferred embodiment, plate 120 provides a baseline for the vertical alignment of second flanges 67 with the junction of lip 8 on the neck of bottle 9 and cork 3 and the alignment of first flanges 36 with circumference 6 positioned between lip or upper ring 8 and lower ring 4.

Handles 40, 90 and 130 are preferably straight elongate members having shapes and dimensions for ease of manipulation. Handles 40, 90 and 130 can include knurling, surface coatings or layers of materials to ease or enhance the manipulation of cork extractor 10.

Figure 4:
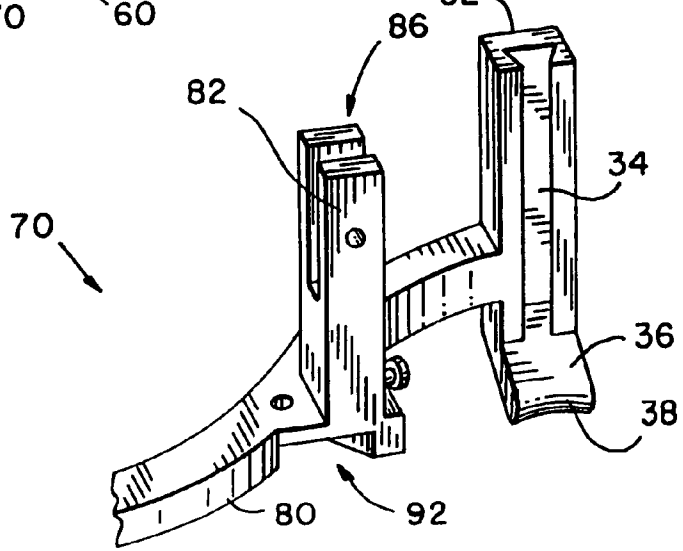
FIG. 4 is a side perspective view of a head portion of one of the gripping members of the cork extractor of FIG. 1.

Referring now to FIGS. 1, 2 and 4, in one preferred embodiment, second gripping member 70 defines a slot 92 for the receiving and pivotal rotating of handle 40. The amount of pivotal rotation of gripping member 20 relative to gripping member 70 in this embodiment can be selectively controlled by the dimensions of slot 92 relative to the dimensions of handle 40. Alternatively, gripping members 20 and 70 can have an uninterrupted planar surface to planar surface interface. A pin connects gripping members 20 and 70.

Cork extractor 10 is preferably fabricated of metal components, but it can also be fabricated from or include components made of plastic and/or composite material having the desired structural integrity. For example, handles 40, 90 and 130 can include enlarged polymer sponge type grips to ease the manipulation of extractor 10. Similarly, cork 3 can be fabricated from a broad range of materials including natural substances such as other cellulose based materials or rubber as well as synthetic materials such as plastics and composites or combinations thereof. In one preferred embodiment, cork extractor 10 is primarily constructed of cast or molded metal components having subsequent finishing operations as desired for a particular application.

Heads 30 and 80 each include a vertical support 32, a first contoured flange 36 and ajaw member 60. Vertical support 32 defines a channel 34 for receiving jaw 60 in sliding relation. Channel 34 is preferably perpendicular to the first plane, but channel 34 can be arcuate or include a series angled segments within the limits of supporting the sliding of jaw 60 and extraction of cork 3 from bottle 9.

First contoured flange 36 is generally aligned with and positioned below channel 34 and extends toward the opposing head 30 or 80 to engage the circumference of bottle 9 in proximity to the neck. Contoured flange 36 preferably has a concave edge for receiving a portion of the circumference of the neck of bottle 9 between lip 8 and ring 4. The edge of contoured flange 36 can include one or more protective inserts, layers or coatings of material 38 such as a rubber or a polymer.

Referring now to FIGS. 2, 4 and 5, jaw 60 has a face 62 that interfaces with cork 3 and a back or rear 64 that slidingly interfaces with channel 34. Face 62 has three cantilevered protuberances including an uppermost extension pin 63, an engagement element 65 and a second tapered flange 67. Pin 63 and element 65 extend generally perpendicular to face 62. Flange 67 is preferably a downwardly depending component that extends from face 62 to engage the neck of bottle 9. In one preferred embodiment, jaws 60 approximate the shape of a "C" from a side view with pin 63 and flange 67 being larger and dominating protuberances from face 62 relative to engagement element 65.

Uppermost extension, pin 63 is an elongate member that extends a predetermined distance from face 62. The length of the extension of pin 63 can selectively vary between the different jaws 60 from equal to unequal lengths. In one preferred embodiment, opposing pins 63 have a difference in length of approximately four to one and are approximately one third of the width of face 62. Pins 63 preferably have a semicircular cross section having a flat surface extending upward, but it is understood that pins 63 can have any shape.

As shown in FIGS. 1 and 3-5, slots 115 receive pins 63 and provide for the pivotal rotation of extractor lever 100 about pins 63 during the vertical sliding movement of jaws 60 in channels 34 of heads 30 and 80. Slots 115 are dimensioned for the unrestricted rotation of extractor lever 100 about pins 63. In one preferred embodiment, the extended length of pin 63 in head 30 accommodates the rotation of first gripping member 20 about second gripping member 70 in slot 92 such that the pivotal range of movement of first gripping member 20 cannot withdraw pin 63 axially through slot 115. In an alternative embodiment, the relative rotational movement of first gripping member 20 and second gripping member 30 are equal and pins 63 are corresponding equal in length. Pins 63 can also include stops on their free ends to preclude their axial disengagement from slots 115.

Referring to FIGS. 2, 4 and 5, engagement element 65 can be a pin having a pointed terminal end, a flange having a tapered terminal edge or any other shape of cantilevered extension that has one or more terminal edges for penetrating into and gripping cork 3. Engagement element 65 has a length and terminal end for gripping cork 3 independent of its material of construction.

Second tapered flange 67 has an edge that is preferably concave and tapered for being inserted between lip 8 of the neck of bottle 9 and cork 3. The length of the extension of flange 67 is sufficient to compensate for the generally spherical shape of the upper portion of cork 3 that extends from lip 8. When face 62 abuts the surface of cork 3, selectively including foil 5 and wire 7, flange 67 will extend between cork 3 and lip 8 in the closed position a sufficient distance to ensure that cork 3 is gripped for extraction.

Back 64 of jaw 60 includes a tapered extension for mating and the slidingly engaging with a taper of channel 34 of vertical support 32. The travel of jaw 60 is limited in the downward direction by flange 37 and is limited in the upward direction by a stop. Alternatively, the upward movement of jaws 60 is limited by the downward travel of handle 130 of extractor lever 100 abutting locking mechanism 50.

As shown in FIGS. 1 and 2, locking mechanism 50 includes a rotating arm 52 and a catch 56. Arm 52 is preferably a flat elongate bar that is secured by a pin 54 to second gripping member 70 on one end and has an opposing free end 55. Arm 52 has a distal elongate edge having one or more notches 58 for connecting with a catch 56 positioned on handle 40 of first gripping member 20. Catch 56 is preferably fixedly positioned for selectively receiving and engaging one of notches 58. Arm 52 can pivotally rotate about pin 54, but the travel of arm 52 in the distal direction is limited by catch 56 and a free end 55 in the opposing proximal direction.

Free end 55 of arm 52 is a vertical downwardly extending portion positioned on the outer side of first handle 40 that limits the travel of first gripping member 20 relative to second gripping member 70 as well as arm 52. A bias member 59 is positioned to urge arm 52 distally and automatically engage catch 56 and at least one of notches 58 when handles 40 and 90 are closed to fix first gripping member 20 and second gripping member 70 in a position securely engaging bottle 9 and gripping cork 3. Locking mechanism 50 is shown positioned on handles 40 and 90, but it is understood locking mechanism 50 could be positioned at any point along the length of members 20 and 70 and accommodate a range of sizes of champagne type bottles 9.

Referring now to FIGS. 1, 2, 7 and 8, in operation foil wrapper 5 is preferably at least partially removed from cork 3 and bottle 9 to at least provide access to wire basket 7. Cork extractor 10 is preferably aligned facing the unwinding section of wire basket 7 and positioned with plate 120 over cork 3. Tabs 122 and 124 of plate 120 assist in the centering and retaining of cork extractor 10 with cork 3. Plate 120 is preferably a contact plate positioned in directly on the upper surface of cork 3, foil 5 and/or wire 7. Flanges 36 are then aligned with area 6 on the neck of bottle 9 between lip 8 and ring 4 and flanges 67 are aligned with the junction of cork 3 and lip 8. Handles 40 and 90 are preferably manually closed to securely engage bottle 9 and grip cork 3. Engagement elements 65 penetrate and grips cork 3. Flanges 36 and 67 engage bottle 9 and cork 3, respectively, as aligned. One of the notches 58 of arm 52 of locking mechanism 50 engages catch 56 to retain first gripping member 20 and second gripping member 70 in the engaged and closed position.

Wire basket 7, unobstructed by cork extractor 10, can be unwound sufficiently for the removal of cork 3 without concern for the unintended expulsion of cork 3 from bottle 9. As desired, cork extractor 10 and cork 3 can be rotated relative to bottle 9. Handles 40, 70 and 130 are retained in one hand while handle 130 of extractor lever 100 is forced in the downward direction to drive jaws 60 upward in vertical supports 32 and extract at least cork 3 and wire basket 7 from bottle 9. In one preferred embodiment, the downward movement of extractor lever 100 is performed with a single hand that is simultaneously grasping handles 40 and 70. Cork 3 is prevented from projecting by the grip of second flange 67, engagement element 65 and plate 120.

Cork extractor 10 is released from bottle 9 and returned to the starting position by disengaging arm 52 of locking mechanism 50 from catch 58. Bias member 111 automatically returns extractor lever 100 to the starting position. Cork 3 can then be manually removed. Cork extractor 10 can also be used to place cork 3 into an opened bottle.

The above describes the principal features of the invention. Although the illustrative embodiments of the present disclosure have been described with reference to the accompanying drawings, it does not limit its application. As will be apparent to one of ordinary skill in the art, the details of cork extractor 10 can vary within the scope of the invention to include, for example, the relative positioning and connection of components such as extractor support 82, bias members, locking mechanism 50 and extractor lever 100. It is to be understood that the above embodiment is illustrative and that, for example, a number of the functions of the individual components can be combined or rearranged without departing from the scope and spirit of the invention which is to be determined with reference to the following claims.

We claim:

1. A cork extractor for removing a cork extending from the top of a bottle, the cork extractor comprising:

a first gripping member having a head portion joined to a handle;

a second gripping member having a head portion joined to a handle, the second member being pivotally connected to the first member for rotation in a plane normal to the axis of the bottle, each of the head portions having downwardly depending flanges for securely engaging opposing sides of the neck of the bottle;

a pair of opposing jaw members slidably mounted on the heads of the first and second members, the jaws including cork gripping means; and an extractor lever pivotally mounted on at least one of the gripping members, the extractor lever including a head portion joined to a handle, the head portion including a contact plate flanked by a pair of walls, the walls operatively receiving a portion of the jaw members for movement relative to the head portion, whereby, pivotal movement of the handle of the extractor lever raises the jaw members relative to the flanges.

2. The cork extractor of claim 1, wherein the extractor lever moves the jaws relative to the flanges positioned in the heads of the first gripping member and the second gripping member.

3. The cork extractor of claim 1, wherein the flanges are arcuately contoured.

4. The cork extractor of claim 3 further comprising locking means to fix the position of the first and second gripping members when the flanges and the jaws are positioned for use.

5. The cork extractor of claim 3, wherein the head includes a vertical support aligned with the flange.

6. The cork extractor of claim 5, wherein the vertical support defines a channel and the jaws are slidingly engaged in the channel.

7. The cork extractor of claim 1, wherein the contact plate receives the cork and is aligned with the axis of the bottle.

8. The cork extractor of claim 1, wherein gripping means at least includes a second flange.

9. A method of extracting a cork from a bottle comprising the steps of:

providing a cork extracting device and a bottle having a neck opening secured by a cork a portion of which cork extends from the neck, a pair of rings extending from the neck proximate the opening, the cork extracting device including a first gripping member and a second gripping member for engaging the bottle and the cork, the first member and second member including head portions having flanges and jaw members, an extractor lever having a head portion including a contact plate and being pivotally connected to one of the gripping members, the head portion of the extractor lever being operatively connected to the jaw members;

positioning the contact plate of the extractor lever over the cork in the bottle and closing the head portions of the first and second gripping members to engage the bottle with the flanges and grip the cork with the jaw members; and pivotally moving the handle of the extractor lever to move the jaw members and extract the cork from the bottle.

10. The method of claim 9, wherein the step of pivotally moving the extractor handle includes moving the head portion of the extractor lever to slide the jaw members relative to the flanges of the first and second gripping members.

11. The method of claim 9, wherein the method includes loosening the wire securing the cork to the bottle.

12. The method of claim 9, wherein the step of positioning the contact plate includes aligning the flanges with the circumference of the bottle between the rings and jaw members with the cork.

13. The method of claim 9, wherein the step of providing includes a locking mechanism and the step of closing includes automatically locking the first member and second member in the position engaging the bottle and gripping the cork.

14. The method of claim 9, wherein the step of pivotally moving the extractor includes using a single hand of a user for grasping the first gripping member, second gripping member, and extractor lever and pivotally moving the extractor lever to extract the cork.

15. A cork extractor comprising:

a first gripping member having a head joined to a handle;

a second gripping member having a head joined to a handle, the second member being pivotally connected to the first member for rotation in a plane normal to the axis of the bottle, each of the head portions having flanges for securely engaging opposing sides of the neck of the bottle;

a pair of opposing jaw members slidably mounted on the heads of the first and second members, the jaws including cork gripping means; and an extractor lever pivotally mounted on at least one of the gripping members, the extractor lever including a head portion joined to a handle, the head portion including a contact plate and a wall, the wall operatively receiving a portion of the jaw members for movement relative to the head portion, whereby pivotal movement of the handle of the extractor lever moves the jaw members relative to the flanges.

16. The cork extractor of claim 15 further comprising locking means for engaging and fixing the first member and the second member in a closed position securely engaging the neck of the bottle.

17. The cork extractor of claim 16, wherein the locking means limits the travel between the first member and the second member in the first plane.

18. The cork extractor of claim 15, wherein the head portion of each gripping member defines a channel for receiving the jaw members and pivoting of the extractor lever slides the jaws in the channel.

19. The cork extractor of claim 18, wherein the head portions of the gripping members include a support defining a channel parallel to the axis of the bottle for receiving the jaw member.

20. The cork extractor of claim 15, wherein the jaw members include pins and the head portion of the extractor lever includes a wall defining slots for operatively receiving the pins, the pivotal movement of the head portion of extractor lever sliding the jaw members in the head portions of the gripping members.

* * * * *